US011944239B1

(12) United States Patent
Randle

(10) Patent No.: US 11,944,239 B1
(45) Date of Patent: Apr. 2, 2024

(54) PORTABLE TOOTHBRUSH STAND

(71) Applicant: Earnest Randle, Blythewood, SC (US)

(72) Inventor: Earnest Randle, Blythewood, SC (US)

( * ) Notice: Subject to any disclaimer, the term of this patent is extended or adjusted under 35 U.S.C. 154(b) by 0 days.

(21) Appl. No.: 17/972,668

(22) Filed: Oct. 25, 2022

(51) Int. Cl.
*A47K 1/09* (2006.01)
*A47B 81/00* (2006.01)
*A47F 7/00* (2006.01)

(52) U.S. Cl.
CPC ..... *A47K 1/09* (2013.01); *A47B 81/005* (2013.01); *A47F 7/0021* (2013.01); *A47F 7/0028* (2013.01)

(58) Field of Classification Search
CPC ..... A47F 7/0021; A47F 7/0028; A47G 29/08; A47K 5/18; A47K 1/09; A47K 5/00; A47B 81/02; A47B 81/005
See application file for complete search history.

(56) References Cited

U.S. PATENT DOCUMENTS 156,572 A * 11/1874 James ..... A47K 1/09 211/74
390,089 A * 9/1888 McClelland ..... B65D 83/687 206/229
453,969 A * 6/1891 Flack ..... A47F 7/0042 211/44
768,456 A * 8/1904 Howard ..... A47K 1/09 211/65
1,291,349 A * 1/1919 Ackers ..... A47K 1/09 248/108
1,319,397 A * 10/1919 Kelsey ..... A45B 5/00 D3/7
1,512,942 A * 10/1924 Mahaffy ..... A47K 1/09 312/207
1,554,257 A * 9/1925 Buckley ..... A47K 1/09 206/362.1
1,841,753 A * 1/1932 Merkle ..... A47F 5/112 211/65
1,870,924 A * 8/1932 Platzer ..... B43K 23/04 248/688
D128,837 S * 8/1941 Vernon ..... D6/682.2
2,417,874 A * 3/1947 Kehl ..... A47K 1/09 206/229
D169,077 S * 3/1953 Mains ..... D6/682.2
2,935,755 A * 5/1960 Leira ..... A46B 7/06 15/186
2,937,910 A * 5/1960 Randa ..... A47K 1/09 248/113
2,957,584 A * 10/1960 Jenkins ..... A47K 1/09 211/90.01
3,002,630 A * 10/1961 Heisser ..... A47K 1/09 248/110

(Continued)

FOREIGN PATENT DOCUMENTS

CA 2514784 3/2007

*Primary Examiner* — Devin K Barnett
(74) *Attorney, Agent, or Firm* — Kyle A. Fletcher, Esq.

(57) ABSTRACT

The portable toothbrush stand is a stand. The portable toothbrush stand comprises a tripod structure and one or more toothbrushes. The one or more toothbrushes are contained in the tripod structure. The tripod structure forms a self-standing structure. The tripod structure forms a plurality of containment spaces. Each containment space selected from the plurality of containment spaces receives an individual toothbrush selected from the one or more toothbrushes.

10 Claims, 3 Drawing Sheets

(56) References Cited

U.S. PATENT DOCUMENTS 3,138,414 A * 6/1964 La Pollo ..... A47K 1/09 312/207
3,155,278 A * 11/1964 Le Baron ..... A47K 1/09 222/93
3,228,737 A * 1/1966 Kipnis ..... A47K 1/09 248/113
3,233,743 A * 2/1966 Di Tirro ..... A47K 1/09 211/65
3,719,283 A * 3/1973 Urda ..... A45D 24/38 D28/74
3,853,365 A * 12/1974 Nielsen ..... A47K 1/09 211/65
4,064,991 A * 12/1977 Swanson ..... A47F 5/0823 211/49.1
D253,736 S * 12/1979 Guarino ..... D6/534
4,214,657 A * 7/1980 Winston ..... A47K 1/09 206/362.1
D270,878 S 10/1983 Sabatella
4,412,618 A * 11/1983 La Conte ..... B25H 3/06 211/13.1
D273,257 S * 4/1984 Barrera ..... D6/530
4,607,752 A * 8/1986 Sherrow ..... B44D 3/123 248/110
D287,791 S * 1/1987 Arnaud ..... D4/107
4,770,379 A * 9/1988 Estvold ..... A47K 1/09 248/110
D301,402 S * 6/1989 Hirsch ..... D4/108
4,880,020 A 11/1989 Schurgin
5,031,778 A * 7/1991 Edgecombe ..... A47F 7/00 248/176.1
D327,194 S * 6/1992 Merkel ..... D6/534
5,138,737 A * 8/1992 Thomas ..... A46B 5/023 15/167.1
5,145,093 A * 9/1992 Zeller ..... B65D 35/28 222/105
5,187,829 A * 2/1993 Atkins ..... A46B 15/0097 D4/125
D342,585 S * 12/1993 Fischbach ..... D28/38
5,297,677 A * 3/1994 Burian ..... A47K 1/09 206/362.4
5,353,464 A * 10/1994 Atkins ..... A46B 5/00 D4/125
5,358,127 A * 10/1994 Ennis ..... A47F 7/0028 211/60.1
D355,804 S * 2/1995 Crivelli ..... D6/530
5,444,889 A * 8/1995 Barre ..... A46B 17/00 248/908
D363,365 S * 10/1995 Beaudoin ..... D28/86
5,480,027 A 1/1996 Leonard
5,590,436 A * 1/1997 Wright ..... A46B 15/0085 446/73
5,615,782 A * 4/1997 Choe ..... A45D 44/02 211/60.1
D408,997 S * 5/1999 Holland ..... D4/108
D414,937 S * 10/1999 Cornu ..... D4/104
6,170,113 B1 * 1/2001 Cornu ..... A46B 5/00 248/688
D469,926 S * 2/2003 Petruccelli ..... D28/73
D472,088 S * 3/2003 Katz ..... D6/534
6,530,502 B2 * 3/2003 Neal ..... A47L 17/00 222/135
6,758,446 B2 7/2004 Bjornrud
6,874,247 B1 * 4/2005 Hsu ..... F26B 9/003 34/107
6,907,638 B2 * 6/2005 Katz ..... A46B 5/00 248/688
6,918,495 B1 * 7/2005 Hoy ..... A47K 1/09 211/66
7,228,976 B2 6/2007 Pretorius
8,651,290 B1 * 2/2014 Fonseca ..... A47F 7/0035 211/65
8,668,171 B2 * 3/2014 Tarantino ..... A47G 21/14 248/37.3
9,427,077 B1 * 8/2016 Zhang ..... A46B 5/0095
10,357,132 B1 * 7/2019 Martin ..... A47K 1/09
2002/0121449 A1 * 9/2002 Bowie ..... A61L 2/26 206/362
2003/0116516 A1 * 6/2003 Belokin ..... A47F 7/0028 211/70.1
2005/0276736 A1 * 12/2005 Miller ..... A47K 1/09 134/84
2005/0279663 A1 * 12/2005 Citrigno ..... A61L 2/18 206/362.1
2006/0011209 A1 * 1/2006 Mehes ..... A47K 1/09 132/310
2006/0048791 A1 * 3/2006 Mehes ..... A45D 44/18 132/310
2006/0076302 A1 * 4/2006 Pretorius ..... A47K 1/09 211/72
2008/0251475 A1 * 10/2008 Lambert ..... A47K 1/09 211/65
2010/0288659 A1 * 11/2010 Dang ..... A47K 1/09 206/362.1
2015/0060373 A1 * 3/2015 Byeon ..... A46B 17/02 211/65
2015/0129522 A1 * 5/2015 Werden ..... A47K 1/09 211/65
2017/0143166 A1 * 5/2017 Kareesan ..... A47G 21/14

* cited by examiner

PORTABLE TOOTHBRUSH STAND

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of devices for holding brushes. (A46B17/02)

SUMMARY OF INVENTION

The portable toothbrush stand is a stand. The portable toothbrush stand comprises a tripod structure and one or more toothbrushes. The one or more toothbrushes are contained in the tripod structure. The tripod structure forms a self-standing structure. The tripod structure forms a plurality of containment spaces. Each containment space selected from the plurality of containment spaces receives an individual toothbrush selected from the one or more toothbrushes.

These together with additional objects, features and advantages of the portable toothbrush stand will be readily apparent to those of ordinary skill in the art upon reading the following detailed description of the presently preferred, but nonetheless illustrative, embodiments when taken in conjunction with the accompanying drawings.

In this respect, before explaining the current embodiments of the portable toothbrush stand in detail, it is to be understood that the portable toothbrush stand is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the portable toothbrush stand.

It is therefore important that the claims be regarded as including such equivalent construction insofar as they do not depart from the spirit and scope of the portable toothbrush stand. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
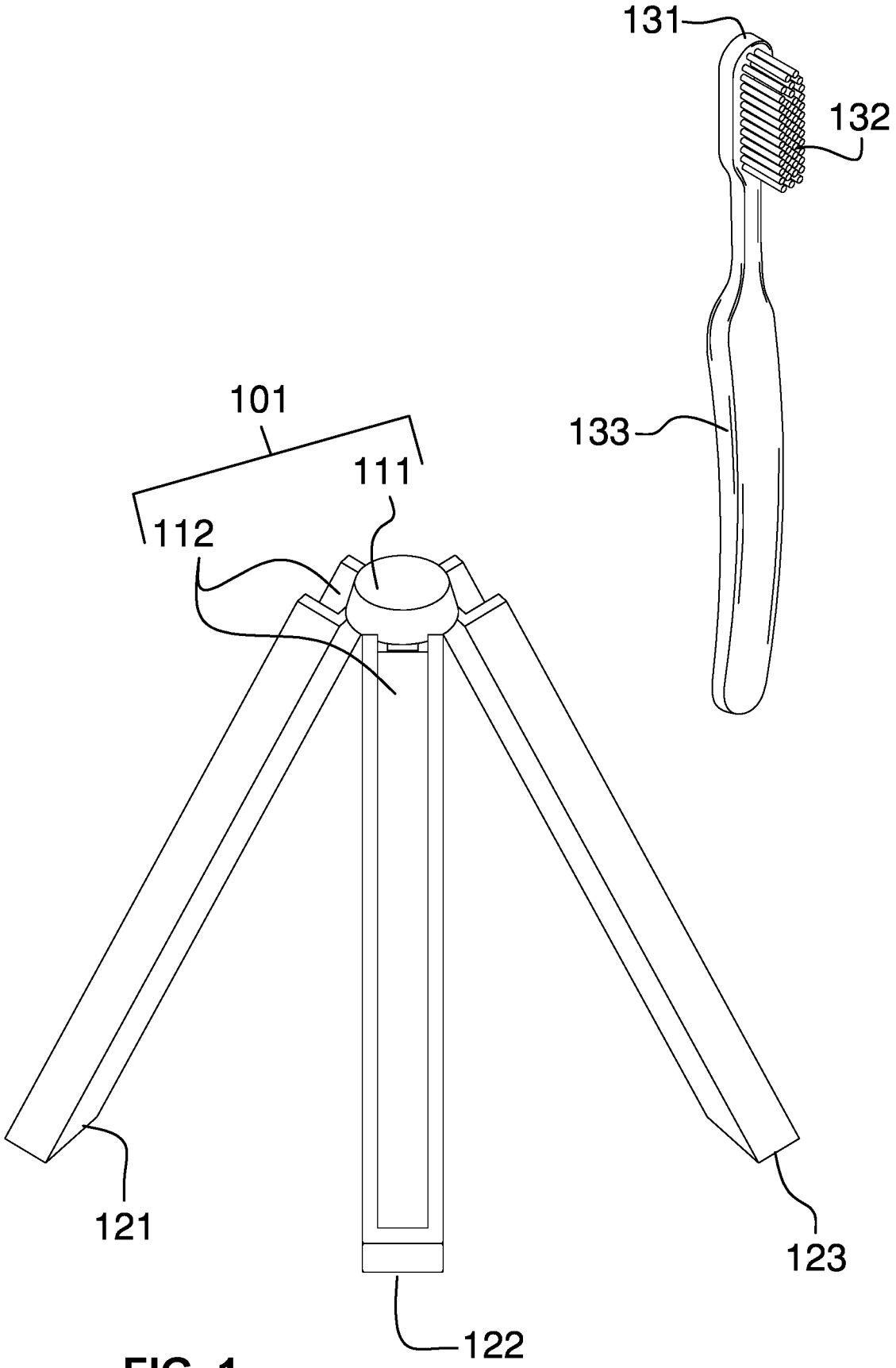
FIG. 1 is a perspective view of an embodiment of the disclosure.
Figure 2:
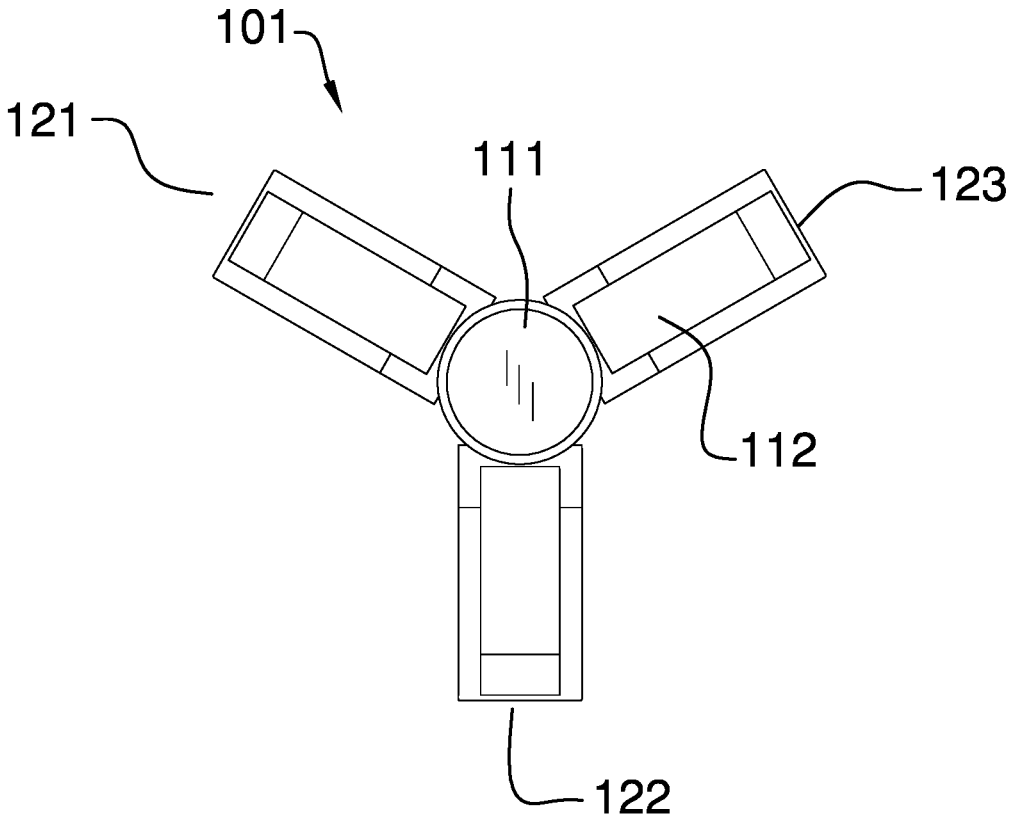
FIG. 2 is a top view of an embodiment of the disclosure.
Figure 3:
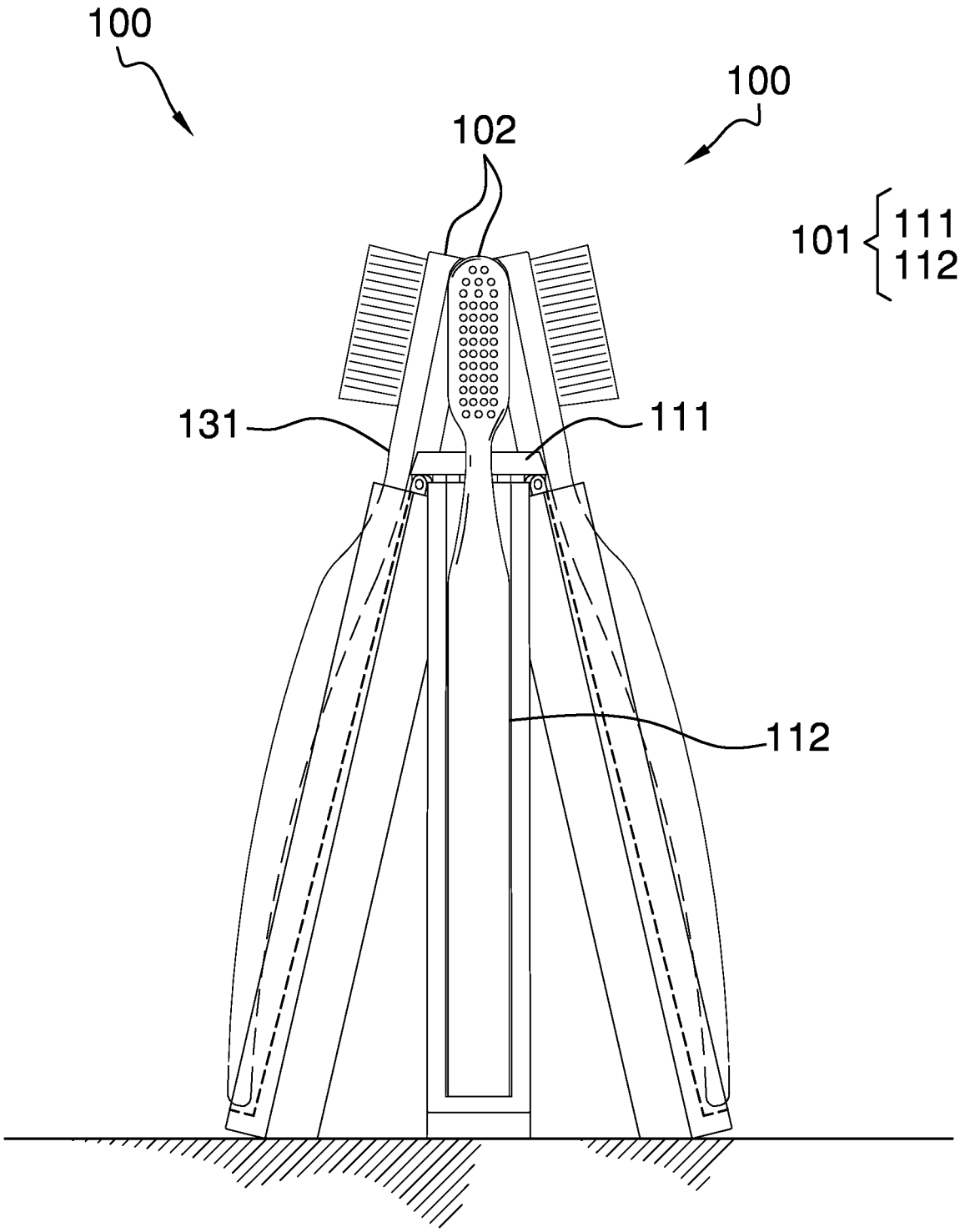
FIG. 3 is an in-use view of an embodiment of the disclosure.

Detailed reference will now be made to one or more potential embodiments of the disclosure, which are illustrated in FIGS. 1 through 3.

The portable toothbrush stand 100 (hereinafter invention) is a stand. The invention 100 comprises a tripod structure 101 and one or more toothbrushes 102. The one or more toothbrushes 102 are contained in the tripod structure 101. The tripod structure 101 forms a self-standing structure. The tripod structure 101 forms a plurality of containment spaces. Each containment space selected from the plurality of containment spaces receives an individual toothbrush 131 selected from the one or more toothbrushes 102.

Each individual toothbrush 131 selected from the one or more toothbrushes 102 is a toothbrush. Each individual toothbrush 131 selected from the plurality of toothbrushes 103 is a therapeutic device. Each selected individual toothbrush 131 is configured for use in cleaning teeth. The toothbrush is defined elsewhere in this disclosure.

The one or more toothbrushes 102 comprises a collection of individual toothbrushes 131. Any individual toothbrush 131 selected from the one or more toothbrushes is stored within a containment space that is formed in the tripod structure. Each individual toothbrush 131 comprises a brush head 132 and a handle 133. The brush head 132 is a brush. The brush head 132 forms the working element of the tool formed by each individual toothbrush 131. The brush head 132 is rubbed against the teeth of a person. The brush head 132 generates a friction against the teeth that is used to clean the teeth. The handle 133 is a grip. The handle 133 is used to carry and manipulate the one or more toothbrushes 102.

The tripod structure 101 is a mechanical structure. The tripod structure 101 is an elevated structure. The tripod structure 101 is a self-standing structure. The tripod structure 101 forms the structure that stores the one or more toothbrushes 102. Each individual toothbrush 131 selected from the one or more toothbrushes 102 is stored in an individual space formed within the tripod structure 101. The tripod structure 101 comprises a disk structure 111 and a plurality of legs 112.

The disk structure 111 is a rigid structure. The disk structure 111 is a disk shaped structure. The disk structure 111 forms the superior structure of the tripod structure 101.

Each leg selected from the plurality of legs 112 attaches to the disk structure 111. Each selected leg forms a gusset. Each selected leg forms a load bearing structure. Each selected leg transfers a portion of the load of the invention 100 to a supporting surface. In total, the plurality of legs 112 transfers the full load of the invention 100 to the supporting surface. Each leg selected from the plurality of legs 112 is a semi-enclosed prism shaped structure.

Each selected leg has a pan shape. The open face of the pan structure of the selected leg is the face of the selected leg that is distal from the solid face of the selected leg with the greatest surface area. The open face of the pan structure of the selected leg forms a congruent end of the prism structure of the selected leg.

The superior lateral face of the pan structure of the selected leg is an open face. The superior lateral face is the lateral face of the selected leg that is proximal to the disk structure 111. The superior lateral face of the pan structure of the selected leg and the open face of the pan structure of the selected leg intersect to form a hypothetical brink.

The hypothetical brink formed by the open face and the superior lateral face of the selected leg forms the superior structure of the selected leg. Each leg selected from the plurality of legs 112 contains an individual toothbrush 131 selected from the one or more toothbrushes 102. Each selected individual toothbrush 131 inserts into its associated selected leg through the superior lateral face and the open face of the selected leg.

The plurality of legs 112 further comprises a first leg 121, a second leg 122, and a third leg 123.

The first leg 121 is a leg selected from the plurality of legs 112. The first leg 121 stores a first individual toothbrush 131 selected from the one or more toothbrushes 102. The second leg 122 is a leg selected from the plurality of legs 112. The second leg 122 stores a second individual toothbrush 131 selected from the one or more toothbrushes 102. The third leg 123 is a leg selected from the plurality of legs 112. The third leg 123 stores a third individual toothbrush 131 selected from the one or more toothbrushes 102.

The second leg 122 is identical to the first leg 121. The third leg 123 is identical to the second leg 122. The third leg 123 is identical to the first leg 121.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Aperture: As used in this disclosure, an aperture is a prism-shaped negative space that is formed completely through a structure or the surface of a hollow structure.

Brink: As used in this disclosure, a brink refers to the edge or line formed by the intersection of a first plane or surface and a second plane or surface wherein a cant exists between the first plane or surface and the second plane or surface.

Brush: As used in this disclosure, a brush is a tool comprising a plurality of bristles set into a handle or a base that is used for grooming, sweeping, smoothing, scrubbing, or painting.

Cant: As used in this disclosure, a cant is an angular deviation from one or more reference lines (or planes) such as a vertical line (or plane) or a horizontal line (or plane).

Cavity: As used in this disclosure, a cavity is a negative space that is formed into but not through an object.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Exterior: As used in this disclosure, the exterior is used as a relational term that implies that an object is not contained within the boundary of a structure or a space.

Foraminous: As used in this disclosure, foraminous is an adjective that describes a surface, plate, disk, or platform that is perforated with a plurality of apertures.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Friction: As used in this disclosure, friction refers to a force that occurs between two objects that are in relative motion while in contact with each other. The force resists the relative motion of the two objects. More technically, friction refers to an exchange of energy between two objects that are in contact with each other that converts the energy of a directed relative motion between the two objects into randomly directed motions of the molecules that form both objects.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Grip: As used in this disclosure, a grip is an accommodation formed on or within an object that allows the object to be grasped or manipulated by a hand.

Gusset: As used in this disclosure, a gusset is an angled structural member used to form a portion of the load path of section of a framework. By angled is meant that the gusset is neither parallel nor perpendicular to the force of gravity.

Handle: As used in this disclosure, a handle is an object by which a tool, object, or door is held or manipulated with the hand.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity when an object is positioned or used normally.

Inner Dimension: As used in this disclosure, the term inner dimension describes the span from a first inside or interior surface of a container to a second inside or interior surface of a container. The term is used in much the same way that a plumber would refer to the inner diameter of a pipe.

Interior: As used in this disclosure, the interior is used as a relational term that implies that an object is contained within the boundary of a structure or a space.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Major and Minor Axes: As used in this disclosure, the major and minor axes refer to a pair of perpendicular axes that are defined within a structure. The length of the major axis is always greater than or equal to the length of the minor axis. The major axis is always the longest diameter of the structure. The major and minor axes intersect at the center of the structure. The major axis is always parallel to the longest edge of a rectangular structure.

Negative Space: As used in this disclosure, negative space is a method of defining an object through the use of open or empty space as the definition of the object itself, or, through the use of open or empty space to describe the boundaries of an object.

Not Significantly Different: As used in this disclosure, the term not significantly different compares a specified property of a first object to the corresponding property of a reference object (reference property). The specified property is considered to be not significantly different from the reference property when the absolute value of the difference between the specified property and the reference property is less than 10.0% of the reference property value. A negligible difference is considered to be not significantly different.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan are open.

Pedestal: As used in this disclosure, a pedestal is an intermediary load bearing structure that forms a load path between two objects or structures.

Perimeter: As used in this disclosure, a perimeter is one or more curved or straight lines that bounds an enclosed area on a plane or surface. The perimeter of a circle is commonly referred to as a circumference.

Primary Shape: As used in this disclosure, the primary shape refers to a description of the rough overall geometric shape of an object that is assembled from multiple components or surfaces.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Prismatic Bifurcation: As used in this disclosure, a prismatic bifurcation refers to the bifurcation of a prism structure by a plane wherein the bifurcating plane is does not intersect the center axis of the prism structure. In a prismatic bifurcation, the center axis can lie on the bifurcating plane. In this instance, the prismatic bifurcation is said to form a horizontal segment.

Rack: As used in this disclosure, a rack is a structure that holds or supports an object in a visible or exposed manner.

Rigid Structure: As used in this disclosure, a rigid structure is a solid structure formed from an inelastic material that resists changes in shape. A rigid structure will permanently deform as it fails under a force. See bimodal flexible structure.

Roughly: As used in this disclosure, roughly refers to a comparison between two objects. Roughly means that the difference between one or more parameters of the two compared objects are not significantly different.

Self-Standing: As used in this disclosure, self-standing refers to a mechanical structure that: a) remains stable on a supporting surface; without, b) requiring the transfer of a portion of the load of the mechanical structure to load paths provided by structures that are independent of the mechanical structure.

Semi-Enclosed Prism: As used in this disclosure, a semi-enclosed prism is a prism-shaped structure wherein a portion of the lateral face of the prism-shaped is removed or otherwise replaced with a negative space.

Stanchion: As used in this disclosure, a stanchion refers to a vertically oriented prism-shaped pole, post, or support.

Stand: As used in this disclosure, a stand is a rack that is intended to hold an object such that the major axis of the object is roughly vertically oriented.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Tool: As used in this disclosure, a tool is a device, an apparatus, or an instrument that is used to carry out an activity, operation, or procedure. A tool generally comprises a working element and a handle.

Toothbrush: As used in this disclosure, a toothbrush is a brush that is used to clean the teeth of a person.

Tripod: As used in this disclosure, a tripod is a three legged structure that forms a load path.

Trough: As used in this disclosure, a trough refers to containment structure that is formed as a prismatic bifurcation.

U-Shaped Structure: As used in this disclosure, a U-shaped structure is a type of offset composite prism structure. The U-shaped structure is a three sided structure comprising a crossbeam, a first arm, and a second arm. In a U-shaped structure, the first arm and the second arm project away from the crossbeam: 1) in the same direction; 2) at a roughly perpendicular angle to the crossbeam, and, 3) the span of length of the first arm roughly equals the span of length of the second arm. An illiterate U-shaped structure refers to a U-shaped structure wherein the span of the length of the first arm differs from the span of the length of the second arm by more than 10 percent. A guided U-shaped structure refers to a U-shaped structure that has: a) the first arc formed by the interior cant formed between the first arm and the crossbeam is greater than or equal to 100 degrees; b) a second arc formed by the interior cant formed between the second arm and the crossbeam is greater than or equal to 100 degrees; and, c) the first arc and the second arc are roughly equal.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

Working Element: As used in this disclosure, the working element of a tool is the physical element on the tool that performs the actual activity, operation, or procedure the tool is designed to perform. For example, the cutting edge of a blade is the working element of a knife.

With respect to the above description, it is to be realized that the optimum dimensional relationship for the various components of the invention described above and in FIGS. 1 through 3 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A portable toothbrush stand comprising a tripod structure and one or more toothbrushes;

wherein the one or more toothbrushes are contained in the tripod structure;

wherein the tripod structure forms a plurality of containment spaces;

wherein each containment space from the plurality of containment spaces receives an individual toothbrush from the one or more toothbrushes;

wherein the tripod structure comprises a disk structure and a plurality of legs;

wherein the plurality of legs attach to the disk structure;

wherein each leg selected from the plurality of legs is a semi-enclosed prism shaped structure that defines each containment space from the plurality of containment spaces respectively;

wherein each leg has a pan shape.

2. The portable toothbrush stand according to claim 1 wherein the tripod structure forms a self-standing structure.

3. The portable toothbrush stand according to claim 2;

wherein each toothbrush from the plurality of toothbrushes is a therapeutic device;

wherein each toothbrush is configured for use in cleaning teeth.

4. The portable toothbrush stand according to claim 3 wherein the tripod structure is a mechanical structure;

wherein the tripod structure is an elevated structure;

wherein each toothbrush from the one or more toothbrushes is stored in an individual space formed within each leg of the tripod structure.

5. The portable toothbrush stand according to claim 4 wherein the disk structure is a rigid structure.

6. The portable toothbrush stand according to claim 5 wherein each leg from the plurality of legs attaches to the disk structure;

wherein the plurality of legs are configured to transfer a full load of the portable toothbrush stand to a supporting surface.

7. The portable toothbrush stand according to claim 6 wherein an open face of the pan shape each leg is distal from a solid face of each leg with a greatest surface area;

wherein the open face of the pan shaped structure of each leg forms a congruent end of the prism shaped structure of each leg respectively;

and is proximal to the disk structure.

8. The portable toothbrush stand according to claim 7 wherein each toothbrush is configured to be inserted into each leg respectively through the open face of each leg respectively.

9. The portable toothbrush stand according to claim 8 wherein the plurality of legs further comprises a first leg, a second leg, and a third leg;

wherein the first leg stores a first individual toothbrush from the one or more toothbrushes;

wherein the second leg stores a second individual toothbrush from the one or more toothbrushes;

wherein the third leg stores a third individual toothbrush from the one or more toothbrushes.

10. The portable toothbrush stand according to claim 9 wherein the second leg is identical to the first leg;

wherein the third leg is identical to the second leg;

wherein the third leg is identical to the first leg.

* * * * *